US006450076B1

(12) United States Patent
Granger

(10) Patent No.: US 6,450,076 B1
(45) **Date of Patent: *Sep. 17, 2002**

(54) FOLDED/UNFOLDED PAPER TOWEL DISPENSING APPARATUS

(76) Inventor: Maurice Granger, 17 rue Marcel Pagnol, 42270 Saint Priest en Jarez (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/776,373

(22) PCT Filed: Jul. 26, 1995

(86) PCT No.: PCT/FR95/00999

§ 371 (c)(1),
(2), (4) Date: Apr. 24, 1997

(87) PCT Pub. No.: WO96/03912

PCT Pub. Date: Feb. 15, 1996

(30) Foreign Application Priority Data

Aug. 3, 1994 (FR) ..... 94 09924

(51) Int. Cl.[7] ..... A47K 10/36; B65H 35/08; B26D 1/62

(52) U.S. Cl. ..... 83/334; 83/337; 83/649; 242/527.1; 242/564.4

(58) Field of Search ..... 83/649, 335, 337, 83/334, 339, 674; 242/560.1, 564.4, 527.1, 542.4; 492/28, 56

(56) References Cited

U.S. PATENT DOCUMENTS

| | | | | | |
|---|---|---|---|---|---|
| 1,543,299 | A | * | 6/1925 | Shelley | 83/334 |
| 1,553,331 | A | * | 9/1925 | Shelley | 83/334 |
| 3,107,957 | A | * | 10/1963 | Batlas et al. | 242/564.4 X |
| 3,301,617 | A | * | 1/1967 | Goodwin et al. | 242/564.4 |
| 3,875,838 | A | * | 4/1975 | Reppert | 83/337 |
| 4,122,738 | A | * | 10/1978 | Granger | 83/337 X |
| 4,188,844 | A | * | 2/1980 | DeLuca | 83/337 |
| 4,213,363 | A | * | 7/1980 | Granger | 83/337 X |
| 4,307,639 | A | * | 12/1981 | DeLuca | 83/337 |
| 4,432,261 | A | * | 2/1984 | DeLuca | 83/649 X |
| 4,441,392 | A | * | 4/1984 | DeLuca | 83/649 X |
| 4,712,461 | A | * | 12/1987 | Rasmussen | 83/649 X |
| 4,846,035 | A | * | 7/1989 | Granger | 83/649 X |
| 5,048,386 | A | * | 9/1991 | DeLuca et al. | 83/649 X |
| 5,078,033 | A | * | 1/1992 | Formon | 83/649 X |
| 5,146,830 | A | | 9/1992 | Granger | 83/649 |
| 5,244,161 | A | * | 9/1993 | Wirtz-Odenthal | 242/560.1 |
| 5,294,192 | A | * | 3/1994 | Omdoll et al. | 242/560.1 |

FOREIGN PATENT DOCUMENTS

| | | |
|---|---|---|
| EP | 0317448 | 5/1989 |
| FR | 2596034 | 9/1987 |
| FR | 2656601 | 7/1991 |

* cited by examiner

*Primary Examiner*—Clark F. Dexter
(74) *Attorney, Agent, or Firm*—Wall Marjama & Bilinski LLP

(57) ABSTRACT

Apparatus for dispensing paper materials from a supply roll mounted within a housing. The housing has lateral flanges for permitting rapid installation of a drum, its associated cutoff device, and a supply roll tensioning device. The drum is a modular unit that includes a main body with an internal hollow shaft for accommodating an assembly at either end. Gripping collars are mounted on the drum and on the end elements which function to ensure retention and dispensing of paper from the supply roll. The length of the drum can be varied, depending upon the type of material being dispensed.

10 Claims, 7 Drawing Sheets

FOLDED/UNFOLDED PAPER TOWEL DISPENSING APPARATUS

BACKGROUND OF THE INVENTION

The invention relates to the technical sector of apparatus dispensing cellulose wadding, creped paper towels and towels of similar materials, especially those used for wiping the user's hands, toilet paper and paper napkins.

Apparatus with automatic cutoff devices dispensing hand-towels where the potential user seizes the paper band to obtain a length of paper for the usage referred to, thereby actuating a given operating cycle are commercially available.

Applicant himself has developed numerous paper dispensing apparatuses, and notably those described in French patent application 9304082 and 9314609.

In these apparatuses, the paper band is cut across its entire unfolded width, thus retaining its original width. One of the original aspects of the dispensers described in the patents referred to earlier is its design, which, requiring only a reduced number of parts, allows rapid field installation with no special tools.

SUMMARY OF THE INVENTION

Summarily, the apparatus comprises a housing featuring lateral flanges formed such as to permit the rapid installation of a drum, its associated paper cutoff device and a tensioning device pressing down onto the drum, both parts locking in position automatically when pressed home and causing the paper band fed from a reel located in the upper housing to be tightened.

As part of various work and research projects carried out by the Applicant on apparatus for dispensing and cutting strips of wound materials, the Applicant proposed, especially in French Patent 2656601, the design of a drum having, either side of its central peripheral part defining the continuity of the cylinder and bounded by the lateral ends of the drum, shaped recesses or openings over a predetermined sector. These recesses make it possible to orientate and engage the corresponding parts of strips of material when the end of the paper band is pulled at an angle by the user rather than pulled normally in the direction of the forward extension of the apparatus. Such a design of the drum also makes it possible to reduce the weight of the drum and improves the operation of the apparatus to ensure a clean cut regardless of the direction in which the paper band is pulled by a user.

As part of the Applicant's research, the latter has also become interested in the design of folded/unfolded paper towel dispensing apparatuses, particularly as defined in French Patent 9404399.

The approach taken by the Applicant, on the basis of all his knowledge and the various above-mentioned patents, has been to concentrate on devising different apparatuses by attempting to achieve modularity of some of the components that can be used in various applications and versions of the apparatus when dispensing folded or unfolded paper towels.

In addition, the characteristics of the various dispensing apparatuses vary in terms of their shape and dimensions depending on various markets and requirements so that there is a very substantial increase in the cost of manufacture, particularly that of dies used to produce the different components and, in particular, the drums which are made of plastic.

The first object sought after by the invention was therefore to devise an apparatus of which the length can be modified easily in order to match the desired applications by using standard dies, thus limiting the number of dies and reducing manufacturing costs.

Another object sought after by the invention was to devise an apparatus of which the dimensions can be perfectly adapted to the demands of the various markets.

Another object sought after by the invention was to benefit from these attempt to enhance the functioning of the apparatus in the sense of improved gripping of the paper band passing over the drum regardless of the direction in which the paper is pulled by the user.

Another object sought after by the invention was to make the drum extremely light whilst nevertheless fulfilling the required functions.

These objects and others will become apparent from the following description.

According to a first characteristic, the drum is made in the form of modular elements and comprises three components including a main body with an internally hollow shaft of small diameter capable of accommodating two assemblies of opposite elements at each of its ends which can be assembled or disassembled quickly comprising a one-piece sleeve of variable length connected to an end flange and in that self-gripping means are placed on the main body of the drum and on the end elements in order to ensure retention and dispensing of the paper band.

BRIEF DESCRIPTION OF THE DRAWINGS

The object of the present invention is described, merely by way of example, in the accompanying drawings in which.

DESCRIPTION OF THE INVENTION

Figure 1:
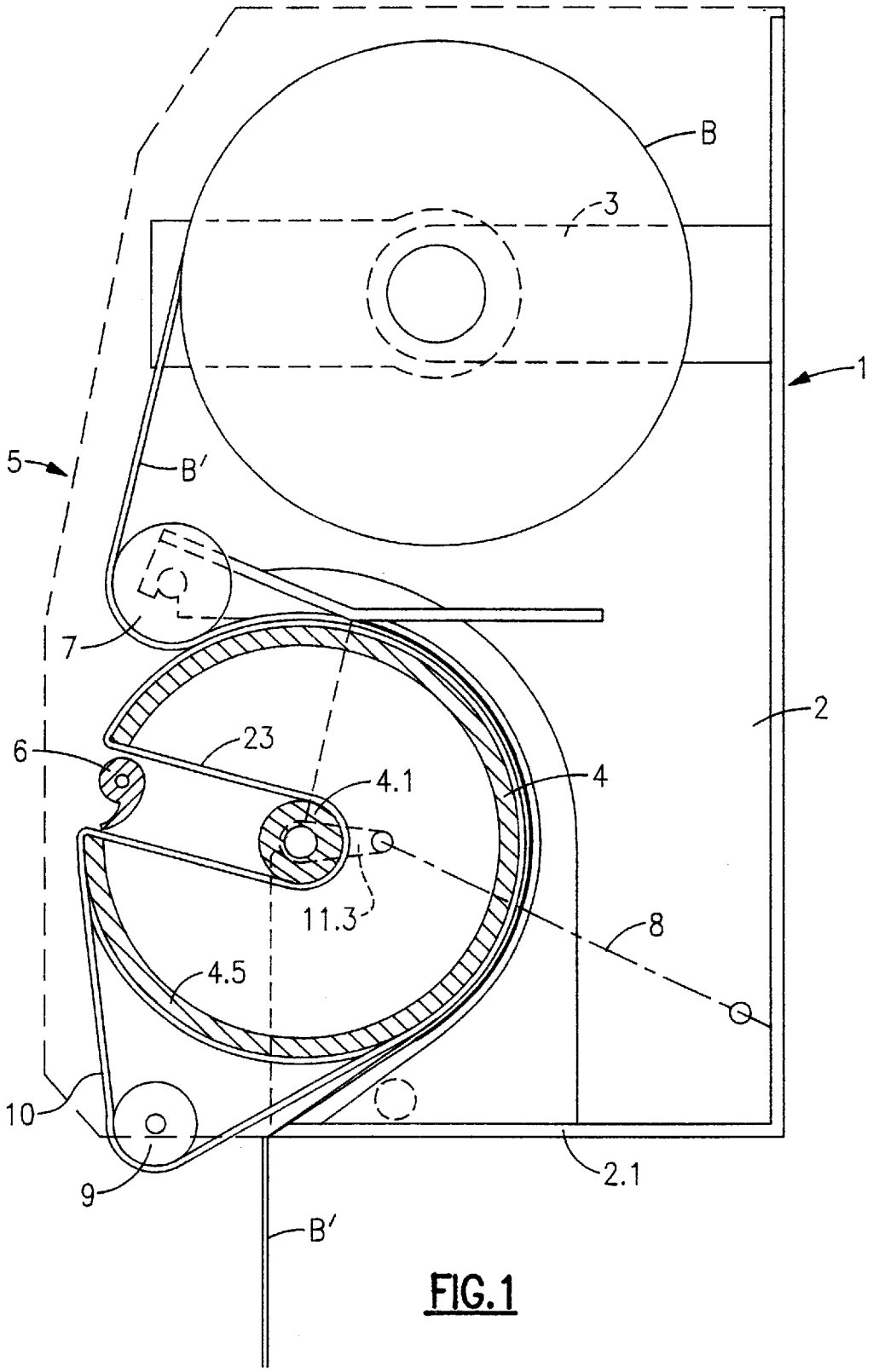
FIG. 1 is a side view of the apparatus according to the invention.

In order that the present invention may be more readily understood, the following description is given, merely by way of example, reference being made to the accompanying drawings.

According to the specifications, this invention is an automatic dispenser of hand-towels, toilet paper or folded lengths of paper such as napkins.

The complete apparatus is shown as (1). In brief, the apparatus (1) requires six or eight components or mechanisms in all to operate as a hand-towel or a toilet paper dispenser, i.e. a moulded plastic housing (2) with moulded reel-holder device (3), a cover (5), a drum (4), a paper cutoff device (6), a tensioning device (7), paper advance means (8) for actuating and reversing the drum and, where necessary, a protective reel (9) and a drive belt (10). In particular, the apparatus comprises a moulded plastic housing (2) the upper part of which is designed to receive a reel-holder device (3) for a reel (B) of towel, toilet or napkin paper, a positioning and hinging drum support with a paper cutoff device (6) and a tensioning device (5) for feeding a paper band (B') to the drum on the one hand and taking up the slack of the paper band on the other. The movement of the knife of the paper cutoff device (6) towards the drum (4) to cut the paper band (B') is obtained by a moulded rack-type device not shown in the drawings mounted on the inside of and onto one of the sides (2.1) of the housing (2). The paper cutoff device (6) can be moved using the mechanisms and arrangements described in French patent Nos. 9304082 and 9314609. The protective cover (5) protects the mechanisms referred to and the paper band (B') to be dispensed. The protective cover is located at and hinges on the base of the housing of the apparatus and is clicked in place to close using a locking tongue (not shown) located in the upper part of the housing or another equivalent locking system.

The apparatus according to the invention is distinctive in that support drum (4) is of modular design making it possible to adapt its length depending on the dimensional features of the apparatus which may vary depending on the type of application and existing markets.

In particular, the drum (4) comprises three components including a one-piece main body (CP) with an internally hollow shaft (4.1) of small diameter capable of accommodating two assemblies of opposite elements (11) (12) at each of its ends (4.2) so that they can be assembled or disassembled quickly, each end assembly (11.2) comprising a one-piece sleeve (11.1–12.1) of variable length connected to an end flange (13–14). The middle part of the actual shaft (4.1) itself accommodates a spacer disc (4.3) having a peripheral groove (4.4) to accommodate the drive belt (10) of the above-mentioned type. On either side of this disc (4.3) there are rings (4.5) (4.6), of the same width, of a diameter equivalent to that of the spacer disc (4.3) and defining an outer diameter of the drum (4), these rings being discontinuous and defining, between their ends, a slot (4.7) for movement and hinging of a knife support as described in terms of its implementation and operation in French Patents 9304082 and 9314609.

The drum (4) thus comprises two opposite half parts (PL–P2) on either side of the central spacer disc (4.3) and each comprises one ring (4.5), (4.6) and one end assembly (10), (12).

The first end assembly (11) comprises the one-piece sleeve (11.1) with a semicircular flange (13), for example, linked to the shaft by a connecting plate (15) significantly offset towards the inside of the drum (4) with respect to the flange (13) in order to define a space allowing movement and pivoting of the rack associated with the knife support. The sleeve (12.1) is made with a radial projection or finger (17) capable of fitting into a slot or scalloping (4.8) formed on the hollow shaft (4.1) and allowing connection to the latter. The sleeve (12.1) is fitted onto the shaft (4.1) by force for example.

Flange (13) has an opening (13.1) sized to receive a pivot pin of the knife support. The end of the sleeve (12.1) extends beyond flange (13) and protrudes beyond the side walls of the housing (2) as a finger (11.2) accommodating a cam (11.3) with a pin (11.4) at its end used to secure one of the ends of a spring (8) for releasing and starting the drum (4). After assembly, the drum clicks into, thanks to finger (11.2), the parts arranged on the housing (2) in the way described in above-mentioned French Patents.

According to another characteristic layout of the invention, rings (4.5) (4.6) are formed on simply part of the length of the drum (4). Between ring (4.5) and semicircular flange (13), a first slot (E1) formed over practically 300 to 330° is provided allowing movement of the paper band, if applicable assuming that the latter is pulled in a variable position, preventing tearing of the paper inside the apparatus. From the shaft (4.1), between the end of ring (4.5) and connecting plate (15) of flange (13), provision is also made to fit and form a radial shaped lug (18) that can be offset as shown in the drawings or be of triangular shape. This lug (18) has one shaped end (18.1) that is devised to be in alignment with one generating line of the drum (4) and its ring (4.5, 4.6) in particular. On the other half piece (P2) of the drum, this allows positioning of the second end assembly 12 comprising a separately mounted sleeve (12.1) of which one end fits into shaft (4.1) and is secured by force or otherwise and is guided by projection or finger (19) capable of penetrating into a cutout or slot (4.8) formed on the aforementioned shaft (4.1). The other end of said sleeve (12.1) is produced with the second flange (14) of the drum. This flange (14) has an opening (14.1) for fitting the shaft of the knife support. Beyond said flange (14), sleeve (12.1) extends as a shaft (12.2) capable of clicking into the hook part formed on the walls of the housing (2), said shaft extending as an operating button (20) in order to allow, if applicable, feeding of the paper band (B') between the tensioning device (7) and the drum (4). Similarly, said sleeve (12.1) has, between its end flange (14) and its area for insertion into the shaft, a radial lug (21) that is offset or forms a triangular projection of which one end (21.1) is curved or rounded so that it is also situated in the plane of the generating line of the drum (4) and its rings in particular. In this way an opening is defined over an angular sector of 300 to 330° between the flange (14) formed on the separately mounted sleeve (12.1) and the opposite ring (4.6).

Figure 2:
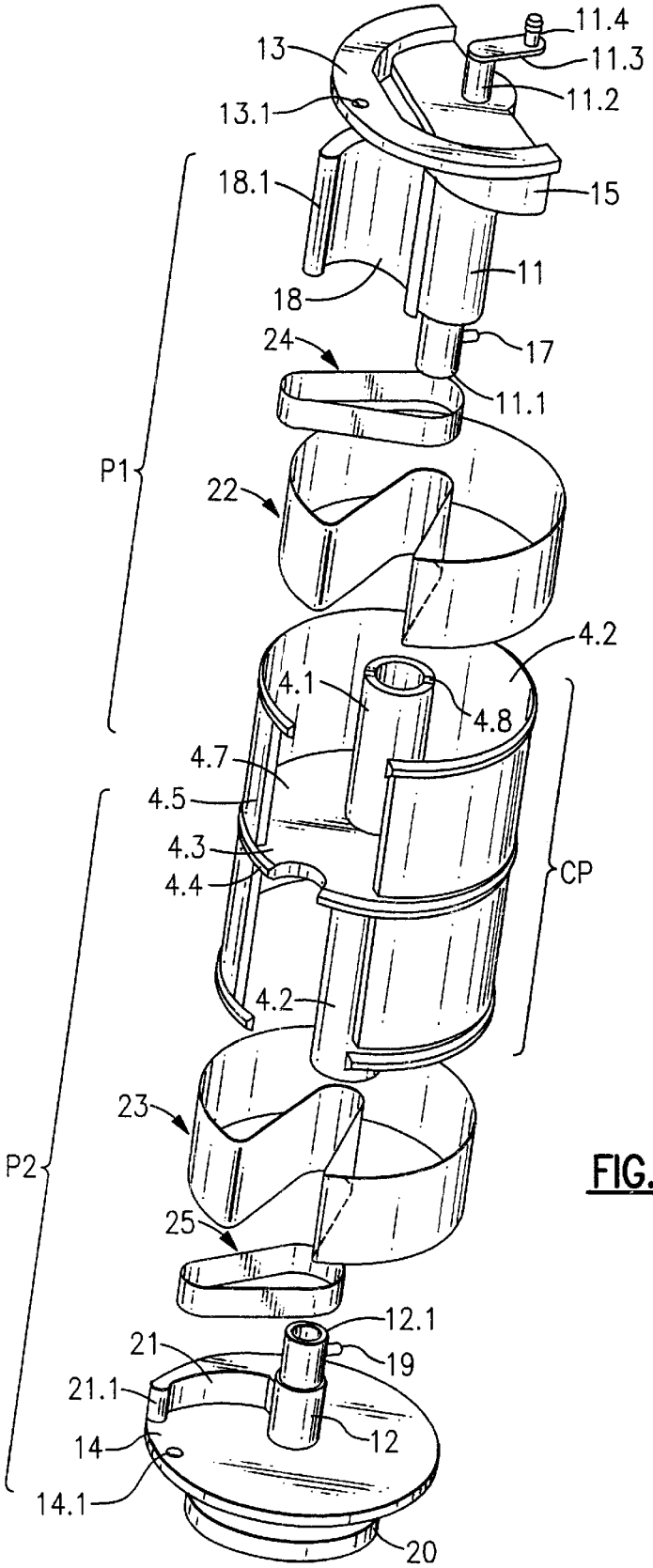
FIG. 2 is a perspective view before the support or paper cutoff device drum components according to the invention are assembled.
Figure 3:
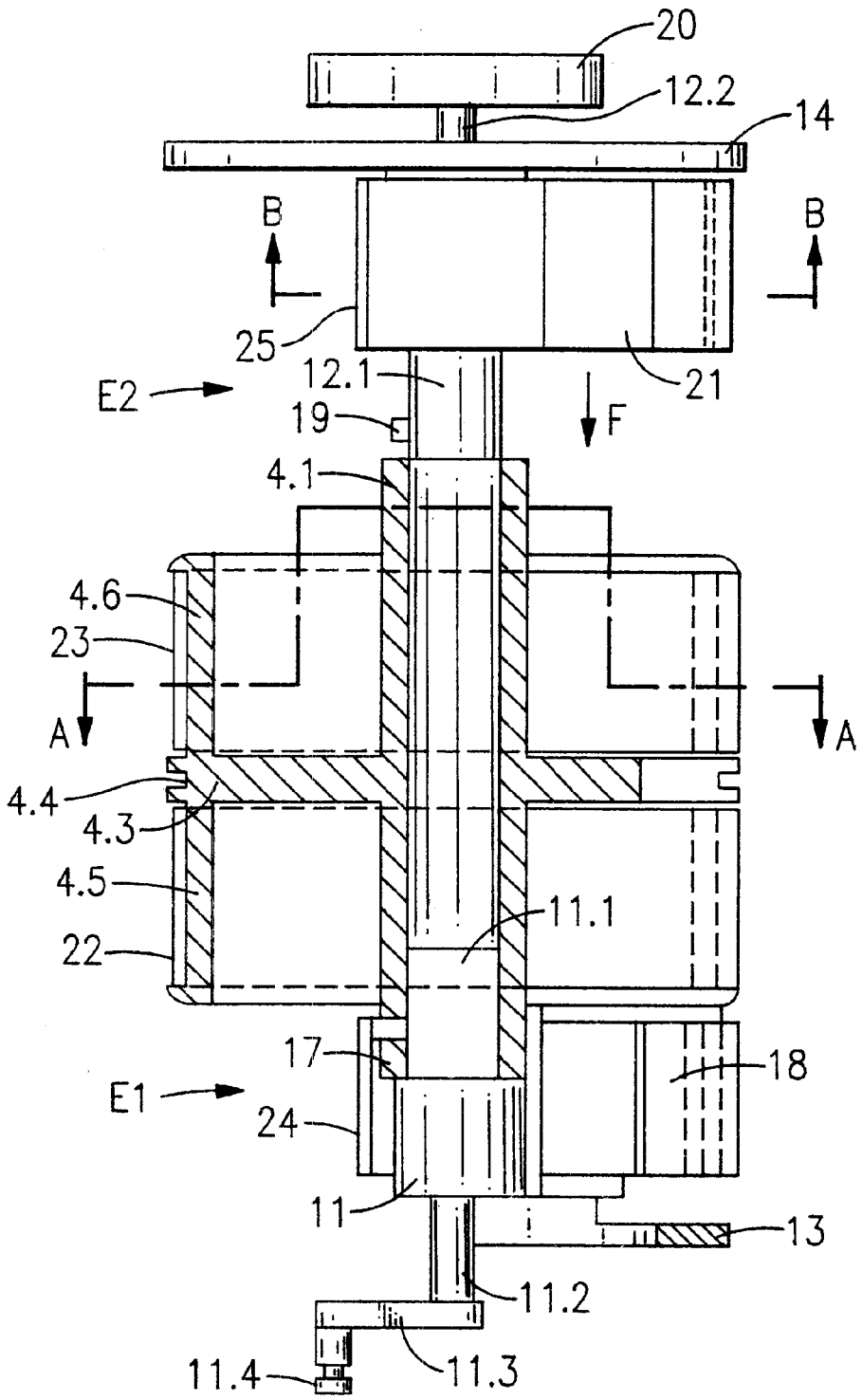
FIG. 3 is a view as in FIG. 2, the drum being in the process of being assembled on one side and actually assembled on the other side.
Figure 4:
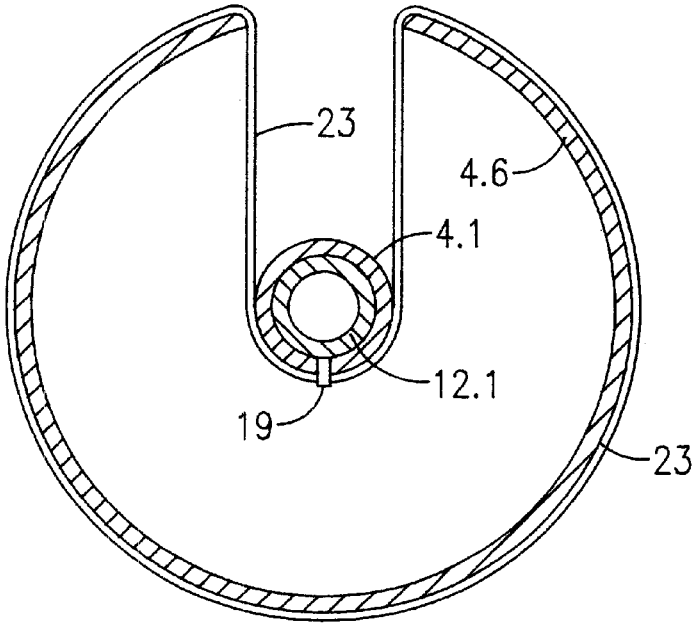
FIG. 4 is a cross sectional view along line AA in FIG. 3.
Figure 5:
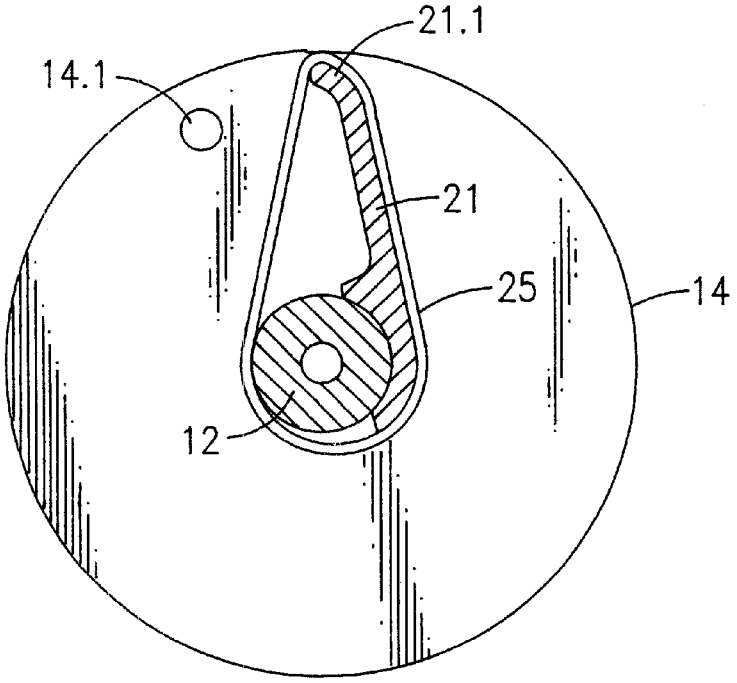
FIG. 5 is a cross sectional view along line BB in FIG. 3.
Figure 6:
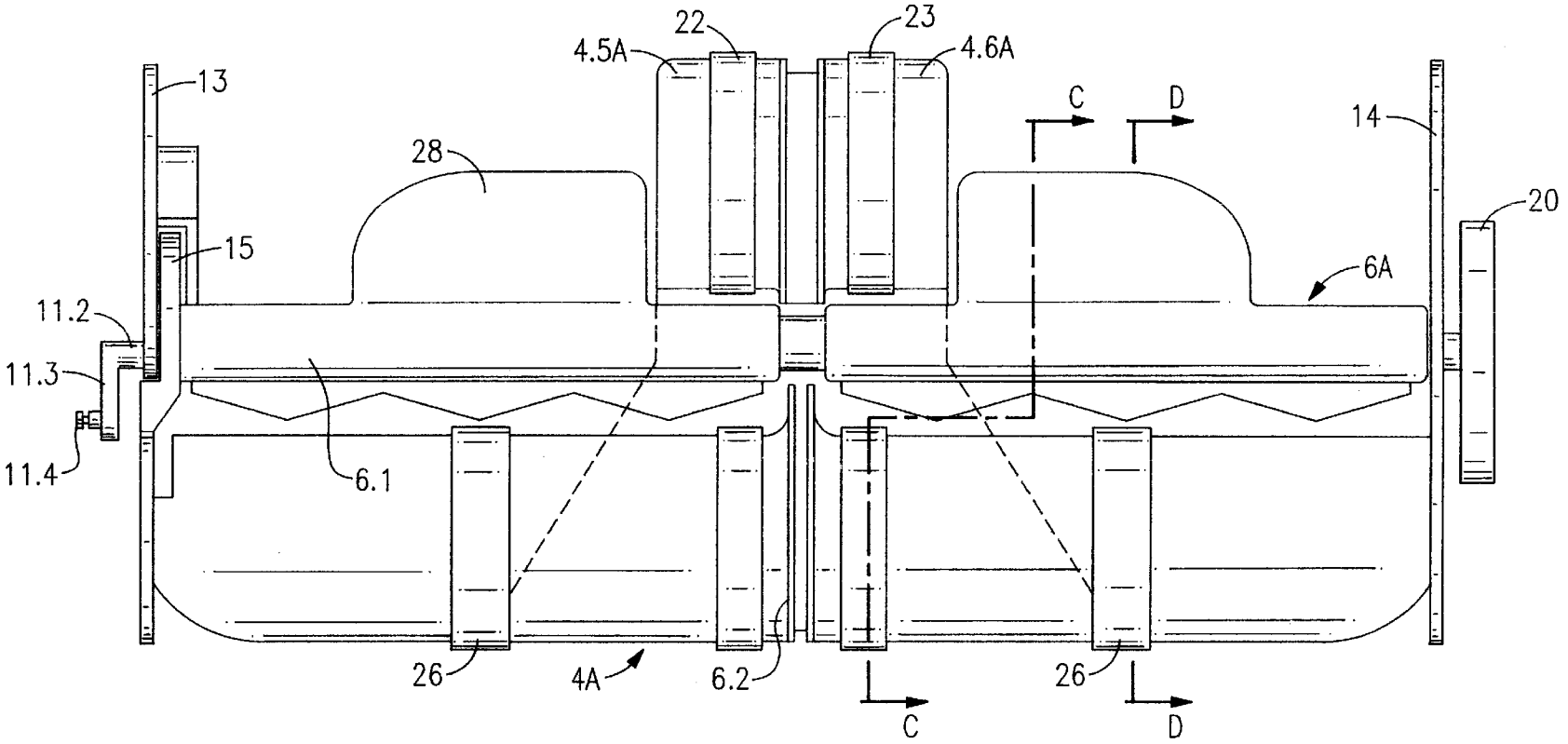
FIG. 6 is a side view of an apparatus according to an alternate embodiment of the present invention.
Figure 7:
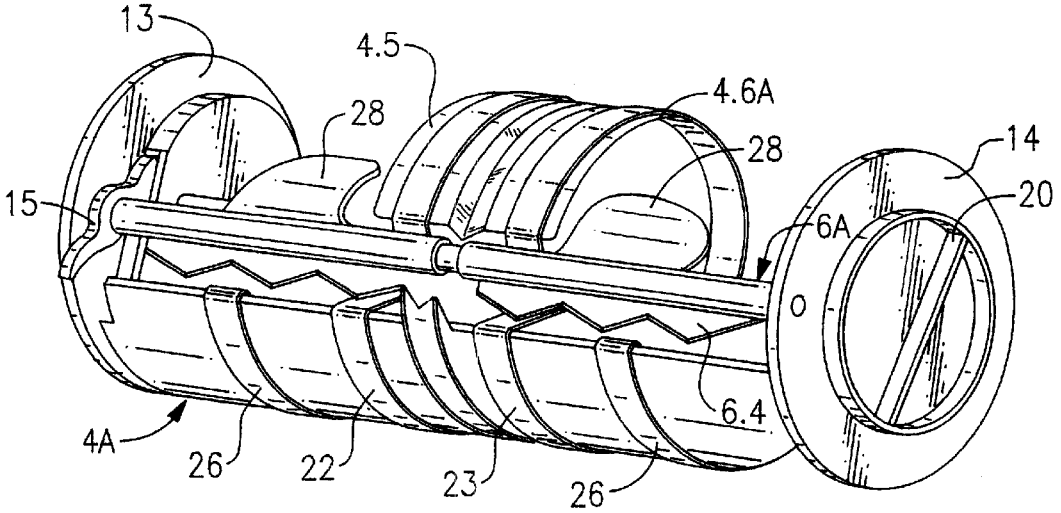
FIGS. 7 and 8 are perspective views of the drum of FIG. 6, with front and rear views allowing its special shape to be shown.
Figure 8:
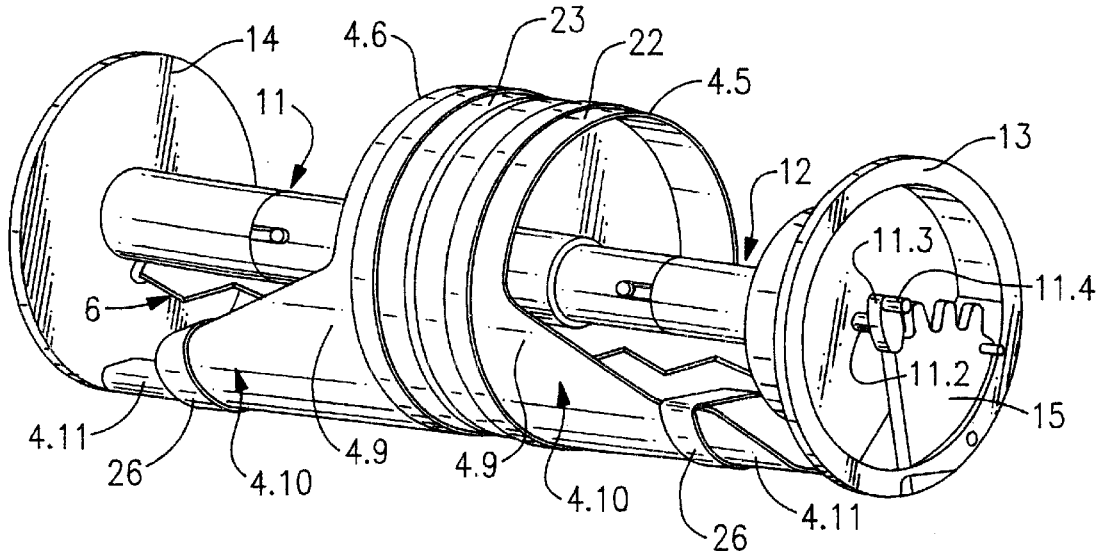
Figure 9:
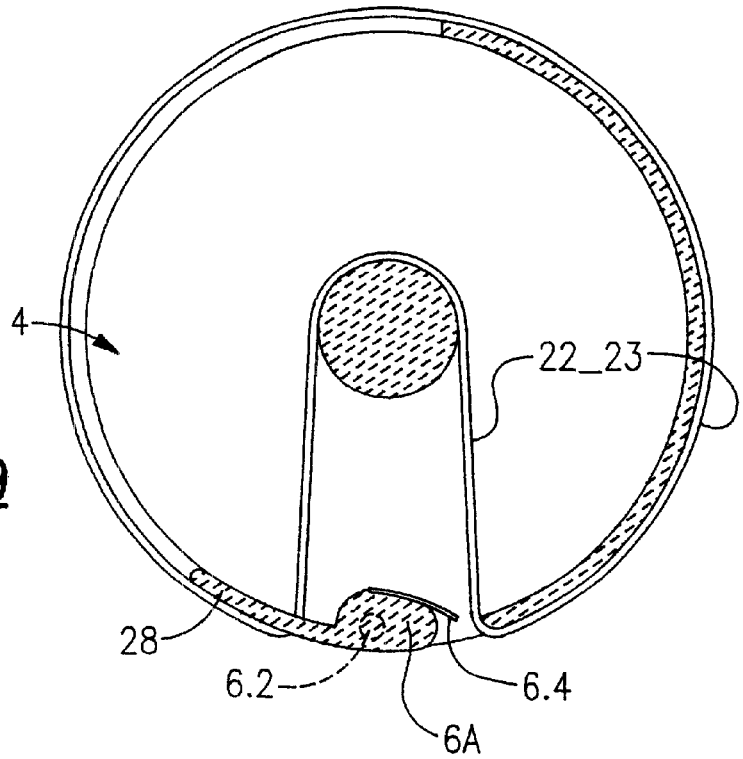
FIG. 9 is a cross sectional view along line CC in FIG. 6.
Figure 10:
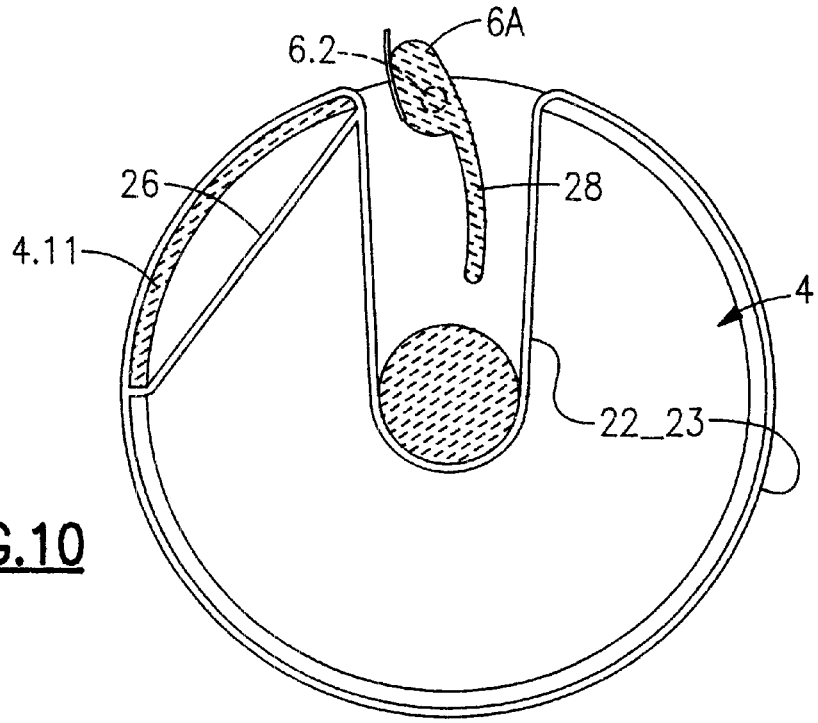
FIG. 10 is a cross sectional view along line DD in FIG. 6.

According to another original layout of the invention, rings (4.5–4.6) as well as support lugs (18) and (21) are designed to accommodate collars (22) (23) (24) (25) made of an elastomer or rubber material defining gripping surfaces in order to ensure better retention and guiding of the paper. Collar (22) is not shown in the exploded view of FIG. 2. As far as the rings are concerned, said continuous collars (22) (23) are elastically fitted and surround the periphery of the rings (4.5, 4.6) and fit inside the drum (4) around shaft (4.1) as shown in FIG. 4 in the drawings (only the attachment of collar (23) is shown in FIG. 4 for clarity). Collar (22), however, is similarly tensioned in this way. At the same time, two matching collars (24) (25) are placed between the end flanges (13), (14) and the respective rings (4.5), (4.6) by being fitted around the shaft (4.1) and the radial support lugs (18), (21). These collars (24), (25) are also tensioned and, at the location of their common generating line, a continuous area is formed along the length of the drum (4) making it possible to keep the band (B') of material gripped. The various collars are assembled in any appropriate way by using their elasticity after disassembly and separating the components of the drum (4), the main body (CP) and the end assemblies (11), (12) in particular. It is pointed out that said collars are in a fixed position after assembly and that they are therefore not stressed as such.

FIGS. 6 to 10 show an alternative embodiment of drum (4A) to improve even further the paper cut, especially when the paper is pulled by the user in an oblique direction relative to the middle transverse axis of the drum.

In this embodiment, said drum (4A) has two meeting rings (4.5A), (4.6A) of the type previously described, but which in this embodiment have on their periphery a symmetrical extension (4.10) defining for both of the rings a helical shape with a paper bearing area (4.9). This helical shape is formed in a gradually increasing and then decreasing manner on an angular sector on each of the rings (4.5A), (4.6A), while leaving a very wide opening so that the paper can move into an oblique position. This helical shape is arranged in a judicious position of the drum (4A) when the latter is rotated and the paper band (B') is pulled, so that the latter rests against said shape forming a bearing plane.

The shape of the drum (4A) is therefore very special, with a step (4.11) being provided at the end of said shapes, allowing for example the additional positioning of elastomer collars (26), with features similar to those of collars (22–23–24–25). These additional collars (26) help increase and improve the paper bearing and guiding plane onto the drum (4A).

According to another embodiment shown, the shaft (6.2) of the knife support (6.1) of paper cutoff device (6A) is arranged as a single piece with two shaped flaps (28) oppositely positioned relative to the shaft of the aforementioned teeth (6.4) and protruding over the shaft. These two flaps (28), directly formed during moulding of the knife support shaft (6.2), are slightly curved and are likely to form paper bearing means when the paper is pulled (at an oblique angle), thus creating a counter-bearing and retaining effect, ensuring and improving the paper cut. These flaps are for example rectangular in shape with rounded eges. The other apparatus arrangements previously described remain unchanged.

According to the invention, the separately fitted sleeves (11.1), (12.1) connected to the end flanges (13), (14) are of variable length and define a span area for the collars that can be adapted to applications. The choice of assemblies (11) and (12) comprising sleeves and end flanges is defined depending on the application type and use of the apparatus.

Without going beyond the framework of the invention and depending on the type of apparatus, provision may be made to reverse the position of the receiving flanges of the cam for starting the drum (4)(4A) on the one hand and of the flange used to fix the rack support and its drive on the other hand in order to adapt and balance the drum (4)(4A) with regard to its various components.

The advantages are clearly apparent from the invention. The new design of the drum (4)(4A) that can be varied and adapted to suit the applications of the apparatus is emphasised. The new layout and configuration of said drum (4)(4A) with the insertion of elastically fitted collars made of elastomer which are very inexpensive to manufacture and quick to fit are also emphasised. Fitting such collars in an advantage because it reduces the manufacturing costs of the drum initially used on which it was necessary to separately fit self-gripping areas made of emery paper or similar material. In this last embodiment it was not possible to vary the dimensional characteristics of the drum which were restricted by manufacturing constraints.

The fitting of various collars on the main body (CP) and on the matching end elements has absolutely no adverse effect on the movement and hinging of the knife support. On the contrary, the nature of the material of which the collars are made affords additional protection of the blade.

The drum according to the invention and its combination with elastically fitted collars can be applied to versions of paper dispensing apparatuses for folded or unfolded paper.

What is claimed is:

1. A paper dispensing apparatus comprising:

a housing having an interior including an upper part and a lower part;

a supply reel of paper material supported in the upper part of said housing interior;

a drum mounted for rotation in the lower part of said housing interior;

a tensioning device pressing against an exterior surface of said drum so as to define a paper path extending from said supply reel between said drum and said tensioning device;

a paper cutoff device being hingeably mounted on and fitted to said drum for rotation therewith so that a paper length being pulled from said apparatus by a user is cut to a predetermined size in accordance with a specific amount of drum rotation;

paper advance means for causing said drum to be additionally rotated beyond said specific amount to unwind an additional length of paper material from said supply roll along said paper travel path after said paper length has been cut by said paper cut-off device, wherein said drum is a modular element including a main body having a hollow internal shaft slidably receiving first and second end assemblies at opposite ends of said shaft, said first and second end assemblies each including a sleeve connected to a respective end flange integral to each said end assembly, wherein each said end flange forms an end wall of said drum upon assembly to said opposite shaft ends; and surface gripping means mounted on each said end assembly and on the main body of said drum for engaging paper extending from said reel along said defined paper path, wherein the main body of the drum includes a spacer disc disposed over a portion of the length of said internal shaft along with a pair of rings which are disposed on opposing sides of said spacer disc, each of said rings having substantially the same axial length relative to each other and a diameter which is substantially quivalnet to the diameter of the spacer disc, said rings being discontinuous and defining a peripheral slot which receives the paper cutoff device, wherein said rings support a portion of said surface gripping means, a part of said portion being received in said peripheral slot, and wherein each sleeve further includes a radial support lug which receives another portion of said surface gripping means thereon separate from that portion supported by said rings.

2. Apparatus as claimed in claim 1, wherein said surface gripping means include a plurality of elastically deformable collars, each said collar being made of an elastomeric material, in which some of said collars are positioned over the rings of the main body and some of the collars are positioned over the radial support lug of each end assembly.

3. Apparatus as claimed in claim 1, wherein the end flange of said first end assembly is linked to said hollow internal drum shaft by a connecting plate, said connecting plate being offset with respect to the end flange of said first end assembly to define an annular space for receiving a moveable swivelable rack associated with a knife support of said paper cutoff device, and in that the sleeve of said first end assembly includes a finger fitted in a slot formed on said drum shaft and in that said end flange of said first end assembly is semicircular and has an opening that receives the knife support and in which an end portion of the sleeve extends outwardly beyond said end flange of said first end assembly, said end portion projecting beyond a side wall of the housing and including a cam with an outwardly extending shaft used to fasten an end of a release spring of said paper advance means.

4. Apparatus as claimed in claim 1, wherein the end flange of the second end assembly includes an opening receiving a shaft of a knife support of said paper cutoff device, wherein the sleeve of said second end assembly includes a shaft fixed to a wall of the housing and having an operating button at a projecting end.

5. Apparatus as claimed in claim 1, wherein the sleeves of each of said first and second end assemblies include at least one projection cooperating with corresponding ends of the drum shaft.

6. Apparatus as claimed in claim 1, wherein said rings each include a peripheral extension defining an angular sector, each said sector having a helical shape which gradually widens and narrows so as to form a paper bearing area when paper from said reel is pulled in a direction which is oblique relative to a middle transverse axis of said drum.

7. Apparatus as claimed in claim 6, wherein said surface gripping means includes deformable paper gripping collars, and wherein said peripheral extensions each include a scalloped area on which said deformable paper gripping collars are positioned.

8. Apparatus as claimed in claim 1, wherein said paper cutoff device includes a shaft supporting a toothed portion on one side thereof, said shaft being fitted with two shaped flaps formed integrally with said shaft and opposite the toothed portion, said flaps extending radially over said hollow internal shaft to form paper material bearing planes.

9. Apparatus as claimed in claim 1, wherein each of the rings extends over only a portion of the axial length of said drum, thereby defining respective drum recesses in conjunction with said radial support lugs.

10. Apparatus as claimed in claim 9, wherein each of said drum recesses are further defined by a radial position of the radial support lugs relative to a corresponding end flange such that each drum recess extends over an angular sector of approximately 300° to 330° relative to said rings.

* * * * *

UNITED STATES PATENT AND TRADEMARK OFFICE

CERTIFICATE OF CORRECTION

PATENT NO. : 6,450,076 B1
DATED : September 17, 2002
INVENTOR(S) : Maurice Granger It is certified that error appears in the above-identified patent and that said Letters Patent is hereby corrected as shown below:

Column 3,
Line 44, the beginning of the sentence the letter "L", should be replaced with the number -- 1 --, and
Line 47, the number "(10)", should be replaced with the number -- (11) --.

Column 4,
Line 14, the word "ring", should be replaced with the word -- rings --.

Column 5,
Line 29, the word "eges", should be replaced with the word -- edges --, and
Line 35, after the word "sleeves", please insert -- (11.1), (12.1) --.

Signed and Sealed this

Tenth Day of December, 2002

JAMES E. ROGAN
*Director of the United States Patent and Trademark Office*